US009731181B2

(12) United States Patent
Klunick

(10) Patent No.: US 9,731,181 B2
(45) Date of Patent: Aug. 15, 2017

(54) BALL SHOOTING TRAINING APPARATUS

(71) Applicant: Albert R. Klunick, Springfield, IL (US)

(72) Inventor: Albert R. Klunick, Springfield, IL (US)

( * ) Notice: Subject to any disclaimer, the term of this patent is extended or adjusted under 35 U.S.C. 154(b) by 0 days.

(21) Appl. No.: 14/048,209

(22) Filed: Oct. 8, 2013

(65) Prior Publication Data

US 2014/0171229 A1 Jun. 19, 2014

Related U.S. Application Data

(60) Provisional application No. 61/710,906, filed on Oct. 8, 2012.

(51) Int. Cl.

| | |
|---|---|
| ***A63B 69/00*** | (2006.01) |
| *A63B 63/08* | (2006.01) |
| *A63B 63/00* | (2006.01) |
| *A63B 71/02* | (2006.01) |
| *A63B 71/06* | (2006.01) |

(52) U.S. Cl.

CPC ..... *A63B 69/0071* (2013.01); *A63B 69/0057* (2013.01); *A63B 63/00* (2013.01); *A63B 63/083* (2013.01); *A63B 69/0002* (2013.01); *A63B 69/0026* (2013.01); *A63B 2071/026* (2013.01); *A63B 2071/0655* (2013.01); *A63B 2071/0694* (2013.01); *A63B 2225/093* (2013.01)

(58) Field of Classification Search

CPC ..... A63B 63/08; A63B 69/36; A63B 67/02; A63B 63/083; A63B 69/0071; A63B 69/0057; A63B 71/022; A63B 69/0026; A63B 63/00

USPC ..... 473/422, 446, 447, 448, 433

See application file for complete search history.

(56) References Cited

U.S. PATENT DOCUMENTS

| | | | | |
|---|---|---|---|---|
| 4,717,149 | A * | 1/1988 | Juhl | 473/429 |
| 5,324,026 | A * | 6/1994 | Conlon et al. | 473/450 |
| 5,913,668 | A * | 6/1999 | Messer | 42/94 |
| 6,044,747 | A * | 4/2000 | Felts | 42/94 |
| 6,139,450 | A * | 10/2000 | Rivers | 473/422 |

(Continued)

OTHER PUBLICATIONS

"Get it Up Higher Basketball Shooting Arc Hoop Training Aid" product web page, URL web.archive.org/web/20120512114710/http://www.jumpusa.com/, pp. 1-2, published May 12, 2012, retrieved from the Internet Sep. 8, 2016.

(Continued)

*Primary Examiner* — Mitra Aryanpour

(74) *Attorney, Agent, or Firm* — Greer, Burns & Crain, Ltd.

(57) ABSTRACT

A ball shooting training apparatus comprises a support member. An arm receiving strut is coupled to the support member and extends in a rearward direction, and is configured for receiving an upper arm of a user. A guide support configured for receiving a forearm of the user is coupled to the support member and extends upward to a distal end to form a substantially 90 degree angle with the arm receiving strut. A support rod is coupled to the support member and extends upward from the arm receiving strut. A shot completion engagement is disposed at or near the distal end of the support rod, and in front of and above the distal end of the guide support.

12 Claims, 6 Drawing Sheets

(56) References Cited

U.S. PATENT DOCUMENTS

| | | | | |
|---|---|---|---|---|
| 6,159,111 | A * | 12/2000 | Purcell | 473/422 |
| 6,544,132 | B1 * | 4/2003 | Tvedt | 473/448 |
| 6,574,899 | B1 * | 6/2003 | Mostello | 42/94 |
| 6,679,794 | B1 * | 1/2004 | Vitello et al. | 473/433 |
| 6,899,646 | B2 * | 5/2005 | Conradi | 473/454 |
| 8,590,440 | B2 * | 11/2013 | Gallo | 42/94 |
| 2006/0003856 | A1 * | 1/2006 | Bennett et al. | 473/447 |
| 2014/0171229 | A1 * | 6/2014 | Klunick | 473/447 |
| 2014/0200102 | A1 * | 7/2014 | Frostino | 473/447 |

OTHER PUBLICATIONS

"KBA Shotmaker," product web page, URL web.archive.org/web/20070104042856/http:www.kbacoach.com/, pp. 1-4, published 2007, retrieved from the Internet Sep. 8, 2016.

* cited by examiner

BALL SHOOTING TRAINING APPARATUS

CROSS REFERENCE

The present application claims priority to U.S. provisional patent application Ser. No. 61/710,906 filed on Oct. 8, 2012, which application is incorporated herein by reference.

FIELD

Fields are devices and methods for athletic training.

BACKGROUND

Optimum performance in sports such as basketball requires a consistent, accurate shot. For an athlete to develop a consistent, accurate shot, it is helpful to practice by repeatedly shooting a ball using a consistent and correct shooting form. This develops muscle memory and allows a correct shooting motion to become natural. To be sure that the practiced shooting motion is correct, feedback can be provided. For example, a coach or trainer can observe the athlete before, during, or after shooting motion and provide verbal feedback. Another way to provide feedback is through a training apparatus.

Some example training apparatuses can partially or fully guide an athlete with feedback to assume a proper shooting form before or during a shooting motion. Alternatively or additionally, some training apparatuses can provide feedback after a shooting motion. Training apparatuses for basketball shooting include visual guides, gloves, tethers, and other devices for providing feedback. Complexity and cost of training apparatuses can vary significantly.

SUMMARY

A ball shooting training apparatus comprises a support member. An arm receiving strut is coupled to the support member and extends in a rearward direction, and is configured for receiving an upper arm of a user. A guide support, configured for receiving a forearm of the user, is coupled to the support member, and extends upward with respect to the arm receiving strut to a distal end to form a substantially 90 degree angle with the arm receiving strut. A support rod is coupled to the support member, and extends upward from the arm receiving strut. A shot completion engagement is disposed at or near the distal end of the support rod, and in front of and above the distal end of the guide support.

DETAILED DESCRIPTION

Figure 1:
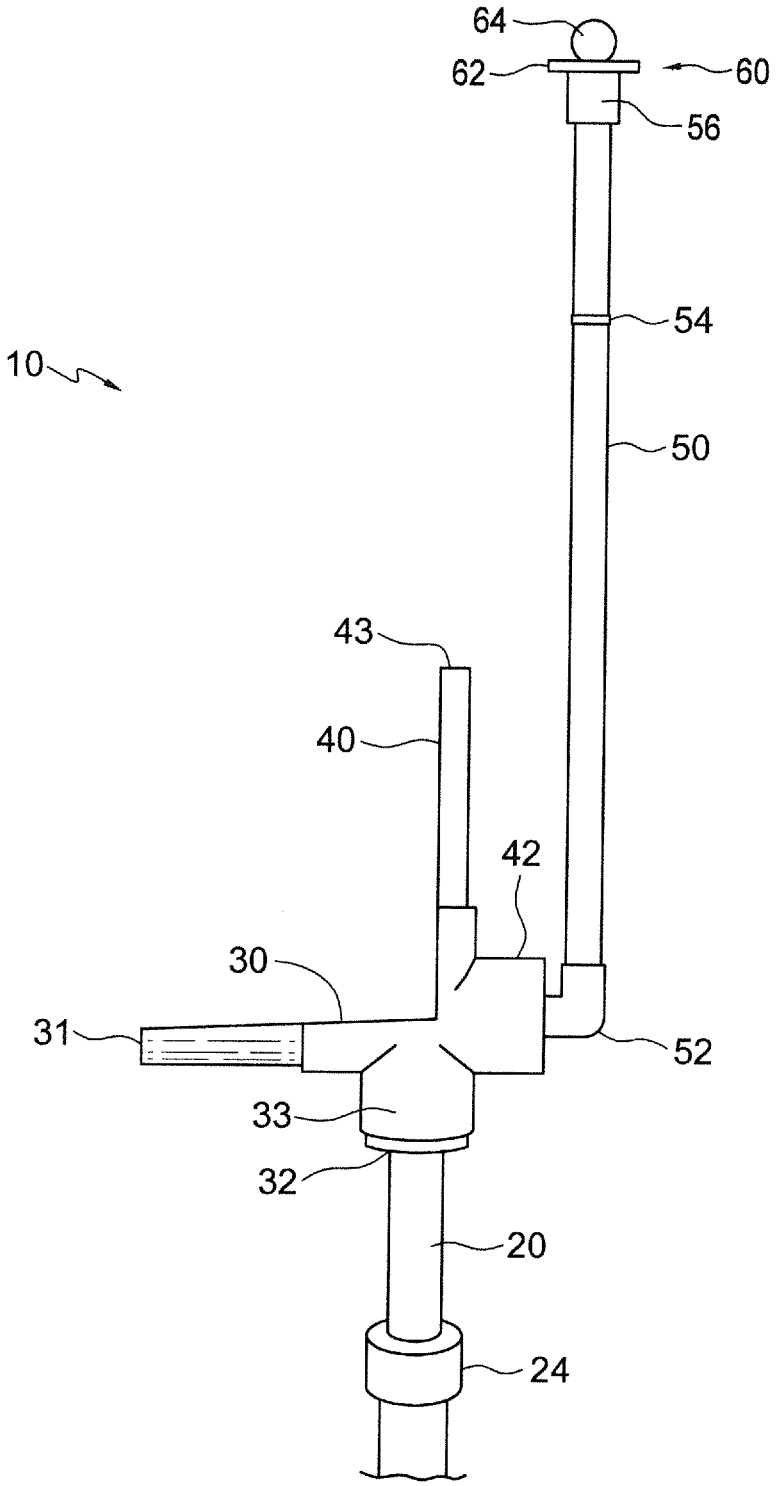
FIG. 1 is a perspective view of a ball shooting training apparatus according to an example embodiment.

Shot accuracy can be improved by improving accuracy in distance, arc, and/or direction (e.g., left-to-right straightness). An embodiment ball training apparatus helps position and provide feedback for a straight ball shot. Shooting a ball using an embodiment ball training apparatus can build muscle memory and provide consistency for shot direction.

An embodiment ball shooting training apparatus comprises a support member extending generally along a vertical direction. "Vertical" as used herein can vary depending on the orientation of the apparatus. In a typical orientation of the training apparatus, "vertical" can be generally taken as a direction perpendicular with respect to a surface such as a floor or pavement on which the training apparatus is disposed. A vertical direction, for example, can be defined as the bottom to top (or vice versa) direction shown in FIGS. 2-6. An arm receiving strut is coupled to and extends in a horizontal, rearward direction from the support member. "Horizontal" is a direction perpendicular to the vertical direction, and can be defined as a left to right, or vice versa, direction in FIGS. 2 and 4-6. "Rearward" or "front" are horizontal directions relative to one another, and in an example embodiment these directions are oriented such that a horizontal component of a ball shooting direction is frontward (e.g., towards a basket). The term "member" is not intended to be limited to a single piece, but can generally refer to one or more pieces connected or integrated in any suitable way. "Coupled" can be direct or indirect. The arm receiving strut is configured for engaging an upper arm of a user. This configuration can be in any of various ways, and nonlimiting examples are provided herein.

A guide support is coupled to the support member, and extends upward with respect to the arm receiving strut at a distal end to form a substantially 90 degree angle with the arm receiving strut. "First," "second," and "third" are used herein for reference only, and are not intended to require a particular order. The guide support is configured for receiving a forearm of the user, and this configuration can be in any of various ways. In an example embodiment, the arm receiving strut and/or the guide support are U-shaped to engage the user's upper arm and/or forearm. However, this is not required in every embodiment.

A support rod is coupled to the support member, and extends upward from the arm receiving strut. This support rod is also disposed in front of (e.g., to the right of in FIGS. 2 and 4-6) the guide support and extends upward from the arm receiving strut. This upward extension can be, for instance, at substantially a 90 degree angle with the arm receiving strut.

A shot completion engagement is disposed at or near the distal end of the support rod, and the shot completion engagement is disposed in front of, and above the distal end of the guide support. "Shot completion engagement" generally refers to any device or component that is positioned to contact or otherwise engage a user's wrist, hand, or fingers during follow through of a shot. This shot completion engagement can be part of the support rod, or can be one or more pieces coupled thereto.

In an example embodiment, the support member and the guide support can each extend longitudinally (along their respective lengths) to define respective vertical axes, and these axes can be coplanar with one another, and thus aligned. In this way, the user can align his or her foot and knee with the support member, engage the arm receiving strut with the upper arm, engage the guide support to align the forearm with the foot and knee, and in shooting extend the arm and rotate the wrist forward so that one or more fingers engage the shot completion engagement, which is also aligned with the forearm, foot, and knee. This example embodiment can thus provide a consistently straight shooting motion for the entire arm from pre-shot to follow through.

In an example embodiment, the support member and/or the support rod are vertically adjustable. This adjustability can be provided by any suitable device, nonlimiting examples of which are provided herein. A base can also be provided for supporting the apparatus, and the support member can extend upwardly from the base. Alternatively, the base can be directly mounted to a surface.

The shot completion engagement can be positionable (either by default, or by manual or automatic adjustment) such that one or more of the user's fingers can engage (e.g., contact in any way) the shot completion engagement when the user's arm is moved to a fully extended position; e.g. during shot follow through. In an example embodiment, the configuration and/or position of the guide support and the support rod allow the shot completion engagement to be positioned so that when the user's arm is extended and the shot completion engagement is engaged, the arm is at an approximately 57 degree angle with the arm receiving strut. This is believed to be an optimum angle for proper shooting, although other angles may be optimal for various body dimensions or other unique individual features.

Preferred embodiments will now be discussed with respect to the drawings. The drawings include schematic figures that are not to scale, which will be fully understood by skilled artisans with reference to the accompanying description. Features may be exaggerated for purposes of illustration. From the preferred embodiments, artisans will recognize additional features and broader aspects of the invention.

Figure 2:
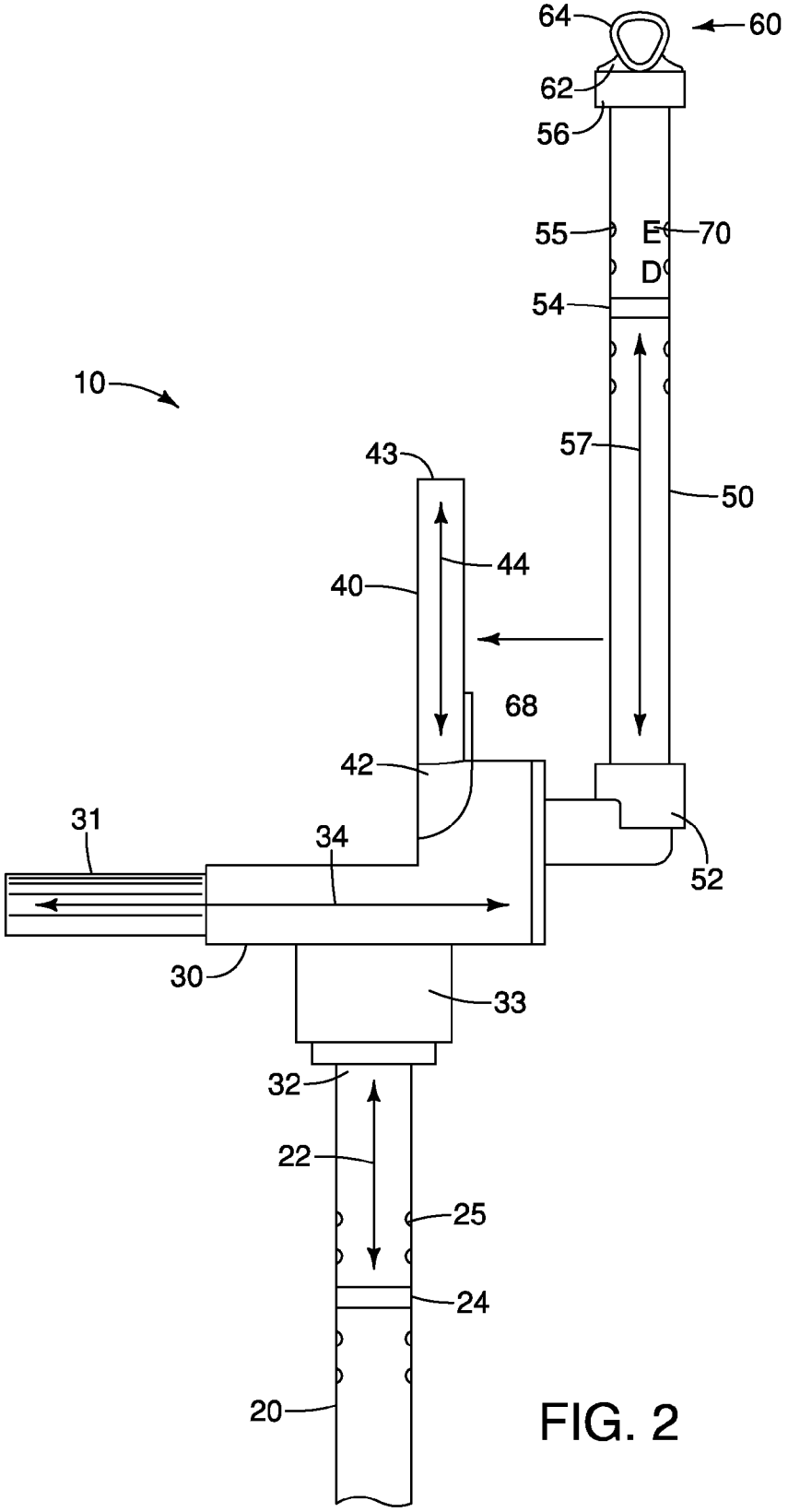
FIG. 2 is a side elevation view of the ball shooting training apparatus of FIG. 1.
Figure 3:
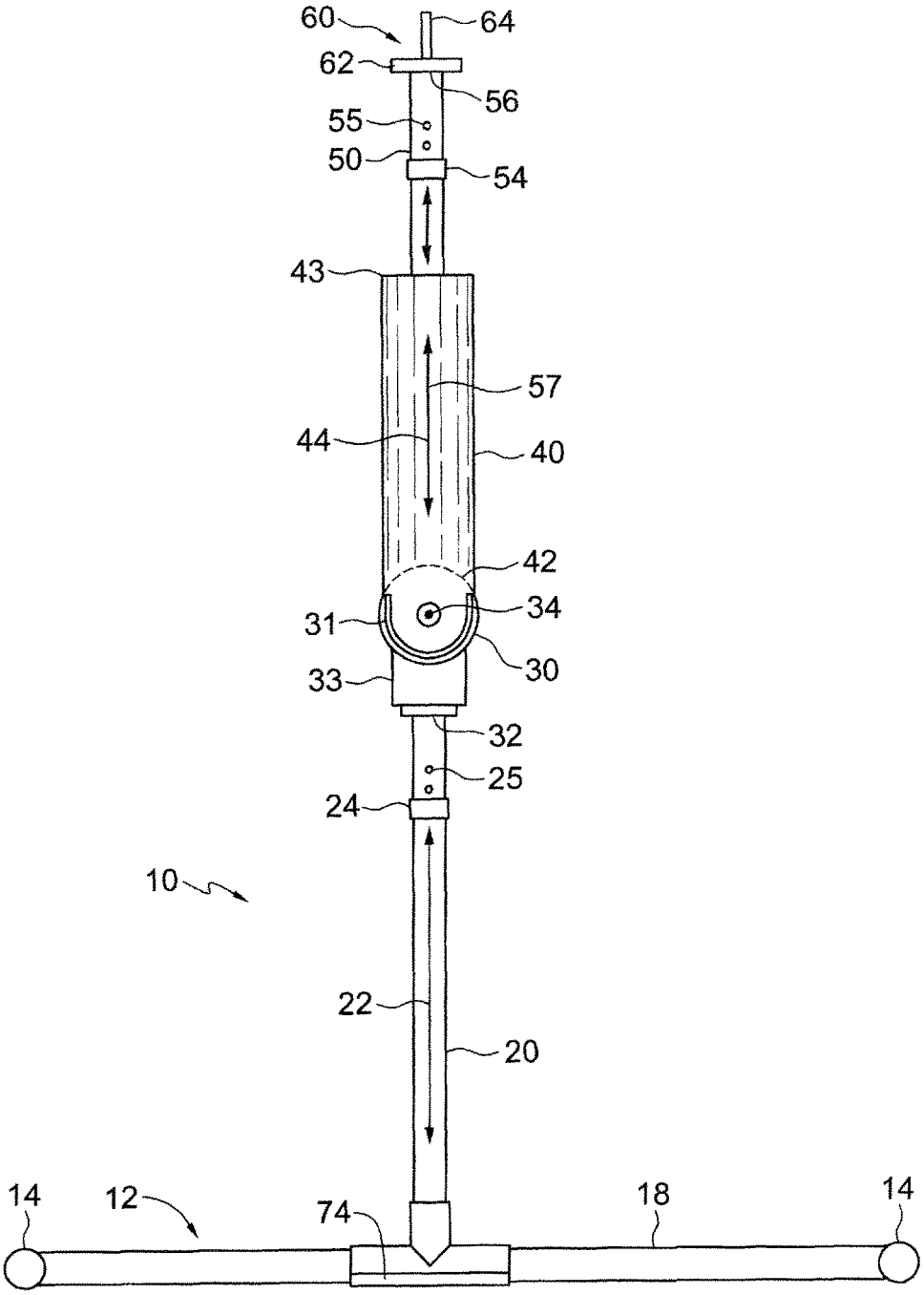
FIG. 3 is a rear elevation view of the ball shooting training apparatus of FIG. 1.

Referring to FIGS. 1-3, an embodiment ball shooting training apparatus (training apparatus) is generally referred to at 10. The training apparatus 10 can be provided, for instance, in a suitable location for shooting training such as but not limited to a basketball court. A base 12 (best viewed in FIGS. 3-6) can be provided for supporting the training apparatus 10 on a surface (not shown), such as a floor or pavement. As a nonlimiting example, the base 12 can be an H-structure including two pairs of horizontally extending legs 14 coupled (e.g., fastened) via suitable couplings 16 to a central left-to-right (in the orientation shown in FIG. 2) extending leg 18. The legs 14, 18 and couplings 16 in a nonlimiting example embodiment are plastic, e.g., PVC, but many other materials are possible. The base 12 may be weighted for stability. In an example embodiment, the base 12 can include a cavity for filling with weight-adding materials such as (but not limited to) water or sand. In another example embodiment, the base 12 may be configured to support a suitable weight for increased stability, e.g., by providing a suitable holder or surface. Those of ordinary skill in the art will appreciate that other base configurations are possible, so long as the base 12 is capable of supporting the training apparatus 10 in an upright position on a surface. Providing the base 12 adds to portability. However, it is contemplated that the base 12 can be omitted entirely, and the training apparatus mounted directly to a surface.

A support member 20 extends upwardly, for instance from the base 12 (though it can instead extend directly from a surface). This support member 20 can be made of any suitable material (lightweight metals, heavier metals, plastics, wood, etc.), and in a nonlimiting example is PVC tubing. This provides advantages related to convenience of manufacture, low weight construction for ease of transport and storage, ease of customization, and other. The support member 20 extends in a longitudinal direction along a vertical axis 22 that can be aligned (in the left-to-right direction as shown in FIG. 2) with a basket, for instance. In an example operation, a user can align his or her shooting side foot and knee with the vertical axis to line up his or her body for making a shot.

In an example embodiment, the support member 20 is vertically adjustable via an adjustment device, such as but not limited to an adjustment pin 24, to raise or lower a height of the training apparatus 10, for instance to adjust the height for a particular user. In a nonlimiting example embodiment, the support member 20 includes inner and outer pipes of smaller and larger diameter, respectively. The outer pipe includes multiple diametrically opposed pairs of alignment holes 25 for receiving the pin 24, and the inner pipe includes one or more diametrically opposed pairs of alignment holes (not shown) for receiving the pin. To adjust the height of the support member 20, the inner pipe is raised or lowered with respect to the outer pipe, the alignment holes for both pipes are aligned, and the adjustment pin 24 is inserted into the alignment holes. Those of ordinary skill in the art will appreciate that other ways of vertically adjusting the support member 20 can be provided as well, including manual (e.g., adjustment screws, threaded adjustments, compression joints, other adjustable pipe connections or adjustable member connections, expandable/collapsible members, cranks, levelers, etc.) or automatic (e.g., motorized or otherwise actuated) adjustment devices.

An arm receiving strut 30 is coupled to an upper end 32 (as a nonlimiting example) of the support member 20, such as via coupling 33. Other couplings can be used, or alternatively the arm receiving strut 30 and the support member 20 can be a unitary piece. The arm receiving strut 30 extends from the support member 20 rearwardly in a horizontal direction. By extending rearwardly in a horizontal direction the arm receiving strut 30 can extend away from a basket and towards a user. The arm receiving strut 30 is configured in any suitable way to engage an upper arm of the user. "Upper arm" as used herein refers to the portion of the user's arm disposed between (inclusive or exclusive) the shoulder and the elbow. In an example embodiment, the arm receiving strut 30 includes a (connected or unitary) receiving saddle 31 that is U-shaped, opened upward to receive a lower portion of a user's upper arm, e.g., just above the elbow, and to provide sufficient contact (e.g., 1-3 inches, though less or more is also contemplated) for comfort and stability. For instance, the arm receiving strut 30 can be a chute, shelf, half-pipe, etc. Example materials include those used for other components of the training apparatus 10. The arm receiving strut 30 in an example embodiment extends longitudinally to define a longitudinal axis 34 that intersects the vertical axis 22 defined by the support member 20. Thus, when the user's upper arm engages the arm receiving strut 30 such the user's elbow faces forward, the elbow is aligned (in the left-to-right direction as shown in FIG. 2) with the vertical axis 22 and accordingly with his or her foot and knee.

To support the user's forearm, a guide support 40 is provided, and can be coupled to the arm receiving strut 30, extending vertically above the arm receiving strut. In a nonlimiting example embodiment, the guide support 40 is fixedly coupled (e.g., mounted) to the arm receiving strut 30 via a coupling 42. It is also contemplated that the guide support 40 can be a unitary piece with the arm receiving strut 30. The guide support 40 is configured in any suitable way to engage the user's forearm. In an example embodiment, the guide support 40 is U-shaped, opened rearward to accept a portion of the user's forearm. Similar components to those used for the arm receiving strut 30 can be used, as a nonlimiting example.

Figure 4:
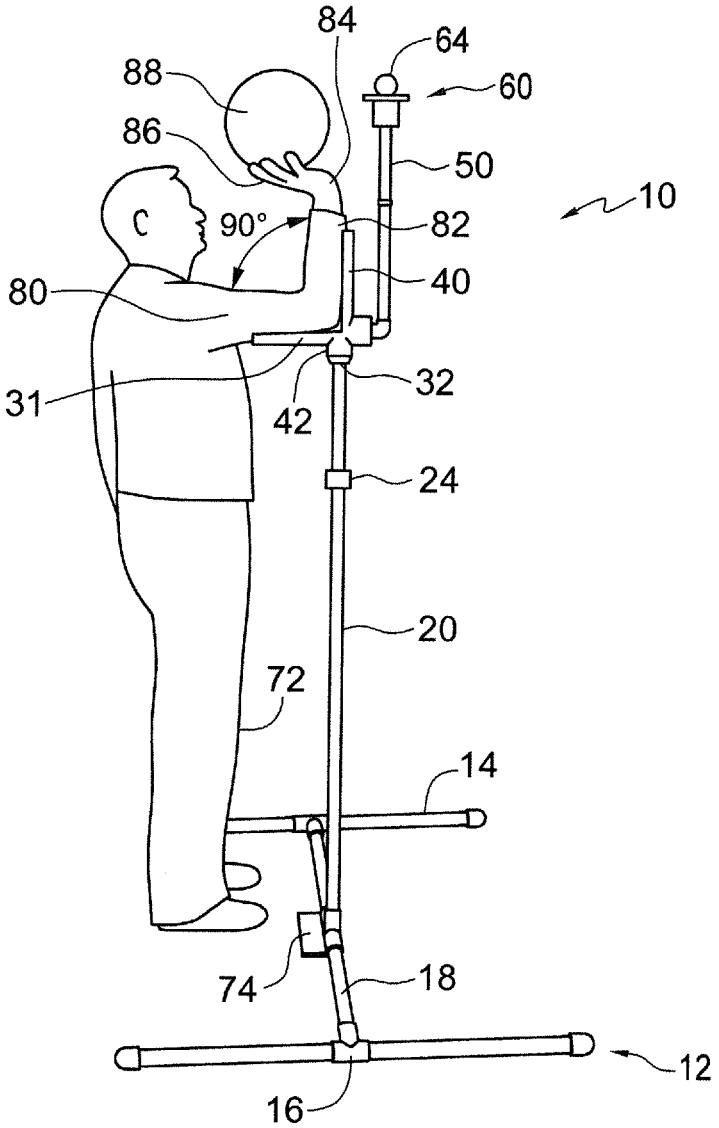
FIG. 4 is a side elevation view as in FIG. 2, showing a user engaged with the apparatus before beginning a shooting motion.

For providing a proper shooting form, the guide support 40 extends to a distal end 43 vertically along a direction that is angled substantially 90 degrees from the extension of the arm receiving strut 30. Further, the longitudinal extension of the guide support 40 can define an axis 44 that is aligned (in the left-to-right direction as shown in FIG. 2) with the longitudinal axis 34 and the vertical axis 22. Thus, by the user placing his or her upper arm to engage the arm receiving strut 30 and his or her forearm to engage the guide support 40 as shown in FIG. 4, the user's complete arm is aligned with the vertical axis 22 and is held in a substantially 90 degree position.

To further assist in aligning a user's shot and to provide feedback for follow through, a support rod 50 is provided, which can be coupled to the arm receiving strut 30. This support rod 50 extends vertically from (i.e., above) the arm receiving strut 30, and is disposed in front of the guide support 40. In an example embodiment, the support rod 50 is coupled to the arm receiving strut 40 via a suitable coupling 52. An adjustment device such as an adjustment pin 54 inserted into alignment holes 55 or other suitable device can be provided for vertically adjusting (raising or lowering) a distal end 56 of the support rod 50. The support rod 50, for instance, can include inner and outer pipes or pieces with appropriately disposed alignment holes as explained above with respect to the support member 20. As with the support member, other suitable devices for vertically adjusting the support rod 50 are possible, including but not limited to those disclosed herein with respect to the support member 20. As shown in FIGS. 1-6, the distal end 56 can be disposed above the distal end 43 of the guide support 40.

Figure 5:
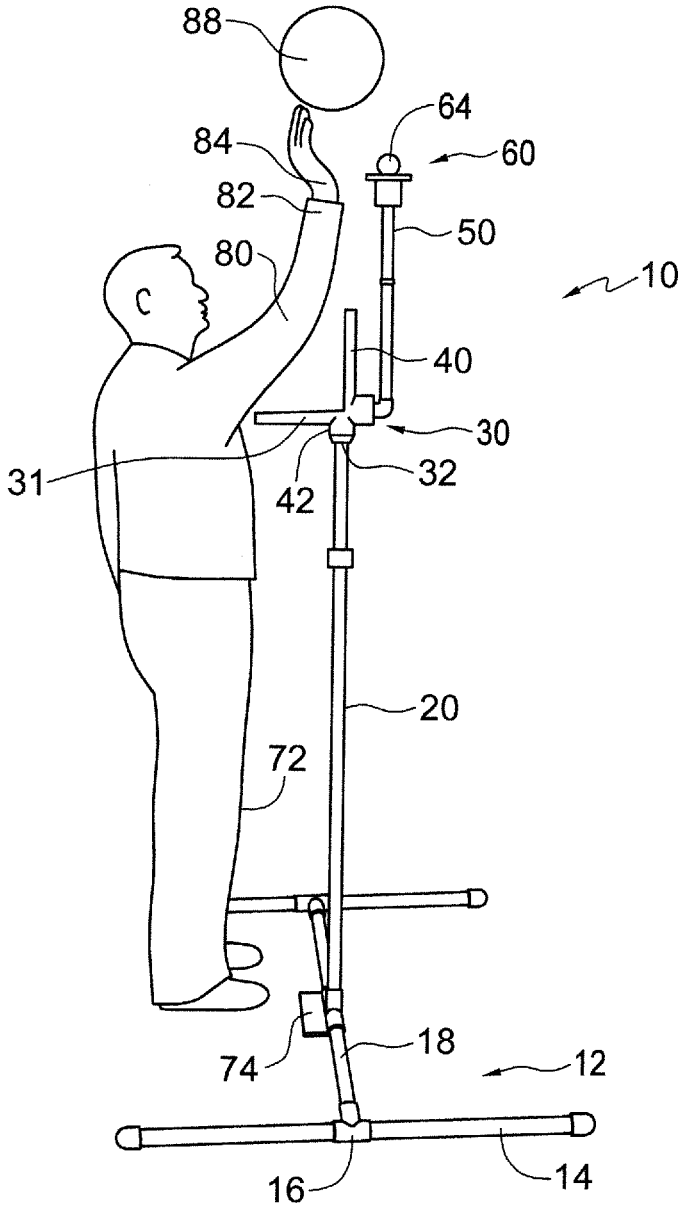
FIG. 5 is a side elevation view as in FIG. 2, showing a user engaged with the apparatus during a shooting motion.

The support rod 50 extends along a longitudinal direction that defines a vertical axis 57. This vertical axis 57 can be aligned (in the left-to-right direction as shown in FIG. 2) with the horizontal axis 34, the vertical axis 44, and the vertical axis 22. In other words, the vertical axes 22, 44, 57 can be coplanar with the longitudinal axis 34, with the longitudinal axis intersecting and being perpendicular to the vertical axes 22, 44, 57. This allows the support rod 50 to align with the support member and guide support 20, 40, providing a clear visual indicator for practicing a shot (FIG. 5 shows an example ball release). The support rod 50 can be made of similar materials as other components of the training apparatus 10.

Additionally, for providing feedback during follow through, a shot completion engagement, generally referred to at 60, is disposed at or near the distal end 56 of the support rod 50. This shot completion engagement 60 can be provided by the distal end 56 itself, or by an additional component coupled to the distal end or elsewhere on or in the support rod 50. In an example embodiment, the shot completion engagement 60 is provided by an eye bolt 62 fixedly coupled to the distal end 56 and a projecting member 64 (as a nonlimiting example, a ring), that projects from the eyebolt. The shot completion engagement 60 is disposed above the distal end 43 of the guide support 40.

The shot completion engagement 60 can be configured and positioned on the support rod 50 so that when a user's arm is extended and his or her wrist is rotated to release the ball, one or more (e.g., two) fingers of the extended hand extend over the shot completion engagement when the user's other fingers, hand, and/or wrist engages the shot completion engagement. An example shot completion engagement 60 having the eyebolt 62 and the projecting member 64 allows at least two of the user's fingers to extend over the shot completion engagement while remaining pointed downward as much as possible. Engagement of the user's fingers, hand, and/or wrist with the shot completion engagement 60 during follow through helps increase muscle memory by providing clear tactile feedback during a proper follow through. This tactile feedback can be provided without the need for tethering the ball, which can impede the ball's flight. In an example embodiment the shot completion engagement 60 includes a soft or pliable surface, such as but not limited to a layer of soft rubber, foam, or soft polymer material to provide for comfort and improve comfort through impact. In such an embodiment the user can perform a shooting motion at normal speed while comfortably engaging the shot completion engagement upon completion of the shooting motion.

Figure 6:
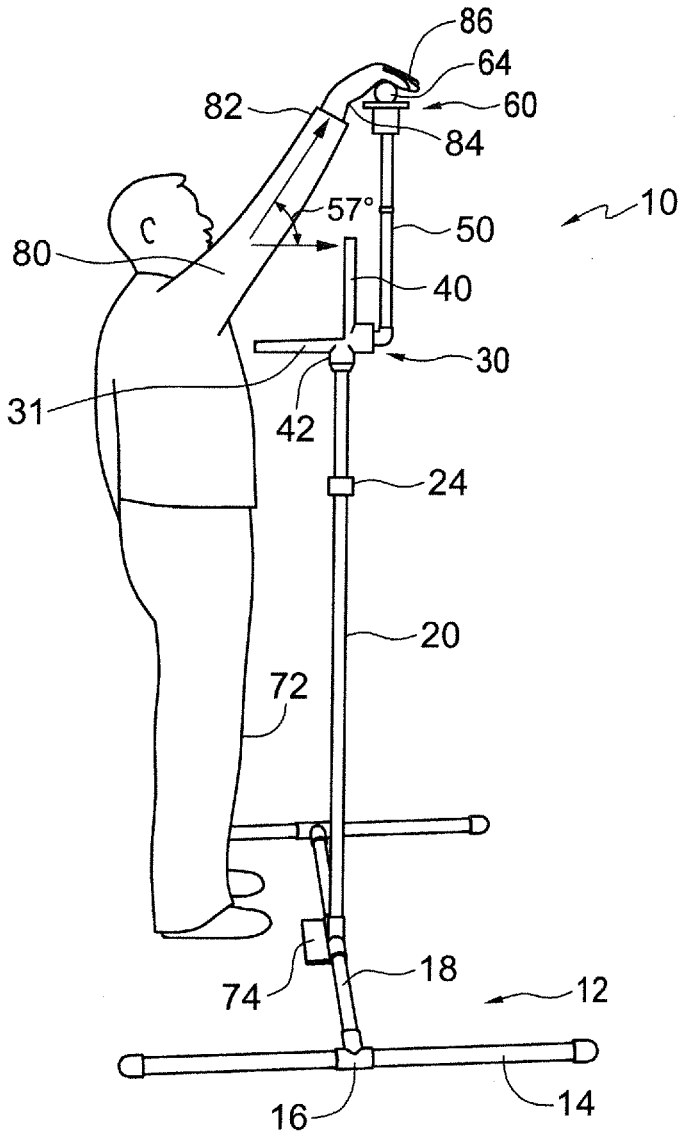
FIG. 6 is a side elevation view as in FIG. 2, showing a user engaged with the apparatus shortly during follow through of a shooting motion.

Referring to FIG. 6, when the user's arm is fully extended at the completion of a shot and during follow through such that the user's fingers engage the shot completion engagement 60, the arm extends along an angle that is approximately fifty-seven degrees (57°) with respect to the extension of the arm receiving strut 40. This fifty-seven degree angle helps provide an optimal shooting form. The location of the shot completion engagement 60 can be provided by a horizontal distance 68 (see FIG. 2) between the guide support 40 and the support rod 50, and by the height of the shot completion engagement 60, which can be based on the height of the distal end 56. By adjusting the height of the support rod 50, for example by using the adjustment device 54, the shot completion engagement 60 can be positioned to provide this approximately fifty-seven degree angle. Other angles may prove optimal on occasion for other users. Various body dimensions, muscle, tendon and joint configurations, and other factors may result in some variance of this angle for different individuals. It is believed that angles of between about 55° and 59° should capture the optimal angle for the vast majority of users. Embodiments of the invention allow for adjustment to this range of angles.

Some invention embodiments also provide indicators for ease of selection of this optimal angle. Indicators may be visual or other. As an example, a indicator 70 disposed on the support rod 50 adjacent to each adjustment location (e.g., pin hole) may highlight the adjustment location to be selected to result in a 57° angle. A correlation guide such as an index, chart, or table can be provided (e.g., packaged with the apparatus, located online, etc.) to indicate a particular adjustment location indicator (e.g., a "yellow" color) for a user's lower arm length. Instead of colors, numerals, letters, symbols, pictures (or combinations thereof—e.g., adjustment "B.2") or other visual indicators may also be provided on the apparatus.

Referring to FIGS. 4-6, to train for shooting a ball using a single arm (i.e. the arm for the user's shooting hand), a user positions the knee 72 and foot corresponding to his or her shooting hand to align the knee and foot with the support member 20 (or alternatively with the similarly aligned guide support 40 or support rod 50). In an example embodiment, a foot positioning indicator such as a pad 74 is disposed on the base 12 for guiding foot positioning. The pad 74 can be marked with a guide such as a foot print (not shown) to assist foot positioning. Such a guide can be adjustable or replaceable for various foot sizes and/or user heights. The pad 74 also can be configured such that the user's aligned foot is placed onto the pad. This can also help stabilize the apparatus in some example embodiments. In an alternative embodiment a knee alignment indicator (not shown) such as a visual indicator (a vertical line, for instance) can be disposed on the support member 20 for assisting in aligning the knee. If the adjustment device (e.g., the adjustment pin 24) is disposed below a typical user's knee, the height of the knee alignment indicator can be raised as the support member's 20 height is adjusted to approximate the user's knee. The user's upper arm 80 is positioned horizontally to engage the arm receiving strut 30, and the forearm 82 is positioned vertically and in front of the upper arm (e.g., toward a basket). In this position, the forearm is disposed at a substantially ninety degree angle with respect to the upper arm, and the user's elbow is aligned with the knee and foot. The visual feedback provided by the support member 20, the guide support 40, and the support rod 50, as well as the tactile feedback provided by the arm receiving strut 30 and the guide support 40, reinforce muscle memory for proper shooting form. The user positions his or her wrist 84 back (e.g. away from the basket) and towards the upper arm, and extends his or her fingers 86 to form a generally C-shape. If the training is performed with a ball, the ball 88 can be placed in the hand after positioning the wrist and extending the fingers.

As shown in FIGS. 5-6, to begin shooting, the user extends his or her forearm 82 to straighten the arm. By positioning the shot completion engagement 60, the straightened arm from the initial perpendicular angle can be moved to an approximately fifty-seven degree angle with respect to the arm receiving strut 30. To release (FIG. 5 shows mid-release), the user rotates the wrist 84 forward and beyond the forearm 82 while the fingers 86 are extended. If the training is performed with the ball 88, extending the forearm 82 and rotating the wrist 84 forward so that the ball rolls off of the index and middle fingers 86 shoots the ball consistently in a straight direction aligned with the support member 20, the guide support 40, and the support rod 50. In an example embodiment, the ball is permitted to freely release from the user's hand, without necessarily being tethered to the training device 10 (e.g., directly or indirectly to the arm receiving strut 30). In this way, the user can also see the path of the unimpeded ball, providing additional feedback (e.g., viewing a straight shot). In some other embodiments, a tether (not shown) can be provided for convenience of retrieving the ball. The tether can be connected, for instance, to the base 12—or to the user (to his non-shooting hand, belt, other location, etc.). Accordingly, some invention embodiments may include a ball with tether, a tether for attachment to a ball, and a tether attachment (with an example being an attachment clip (not shown) disposed on the base 12 or the support member 20.

During the shot follow through, the user's wrist 84 continues to rotate while the fingers 86 remain extended. The index and middle fingers 86 on the user's shooting hand point down as the wrist 84 is rotated, and engages the shot completion engagement 60. At this stage, as shown in FIG. 6, the user's arm can be extended at approximately fifty-seven degrees and aligned with the support member 20, the guide support 40, and the support rod 50, and the tactile feedback provided by engaging the shot completion engagement 60 further reinforces muscle memory.

An example training device 10 provides clear visual and tactile feedback for a user to reinforce proper shooting form. Further, operation of the example training device 10 is simple and can be performed by the user without assistance. An example training device 10 avoids the need for tethers or gloves, while rapidly developing muscle memory for proper form. Further, an example device can be made relatively inexpensively, can be made unitary or in assembled parts depending on the embodiment, and can be rugged, without many moving components (though it is contemplated that multiple parts can be movable as desired). Example devices 10 can be adjustable to various user heights, portable if desired, and lightweight.

While various embodiments of the present training device 10 have been shown and described, it should be understood that other modifications, substitutions, and alternatives are apparent to one of ordinary skill in the art. Such modifications, substitutions, and alternatives can be made without departing from the spirit and scope of the invention, which should be determined from the appended claims.

Various features of the invention are set forth in the appended claims.

What is claimed is:

1. A ball shooting training apparatus comprising:

a support member, said support member being vertically extendable;

an arm receiving strut configured for receiving an upper arm of a user, said arm receiving strut being coupled to the support member and extending in a rearward direction along a horizontal axis, the arm receiving strut comprising a receiving saddle having a U-shape opening in an upward direction to accept a portion of the user's upper arm;

a guide support configured for receiving a forearm of a user, the guide support being coupled to and extending upward from the support member, wherein the arm receiving strut extends rearwardly from the guide support, the guide support forming a substantially 90 degree angle with respect to the arm receiving strut, the guide support having a U-shaped opening in a rearward direction to accept a portion of the user's forearm;

a support rod coupled to the support member and extending upward from the arm receiving strut, the support rod being disposed in front of the guide support;

a shot completion engagement disposed at a fixable position at an upper distal end of the support rod and entirety in front of and above a distal end of the guide support;

means for adjusting a height of the support member along a first vertical axis; and means for adjusting a height of the shot completion engagement along a second vertical axis;

wherein the horizontal axis intersects the first vertical axis and the second vertical axis; and wherein the horizontal axis, the guide support, and the support rod are coplanar.

2. The apparatus of claim 1, further comprising:

a base;

wherein said support member is adjustably coupled to and extends upwardly from the base.

3. The apparatus of claim 1, wherein said shot completion engagement is fixedly positionable along the second vertical axis such that one or more of the user's fingers can engage said shot completion engagement when the user's arm is moved to a fully extended position.

4. The apparatus of claim 1, wherein said support rod is disposed in front of said guide support by a horizontal distance;

wherein the horizontal distance is adjustable.

5. The apparatus of claim 1, wherein said shot completion engagement is positionable with respect to said support member such that one or more of the user's fingers can engage said shot completion engagement when the user's arm is moved to a fully extended position that is at an approximately 57 degree angle with respect to the horizontal axis.

6. The apparatus of claim 1, wherein the shot completion engagement comprises:

an eyebolt disposed at and fixedly coupled to the upper distal end of the support rod, and a projecting member projecting from the eyebolt.

7. The apparatus of claim 6, wherein the projecting member is a ring.

8. The apparatus of claim 4, wherein the support rod extends along the second vertical axis.

9. The apparatus of claim 8, wherein the means for adjusting a height of the shot completion engagement comprises:

a plurality of alignment holes disposed vertically along the support rod; and an adjustment pin for inserting into the alignment holes;

wherein the apparatus further comprises:

an indicator disposed on the support rod adjacent to each of the plurality of alignment holes.

10. The apparatus of claim 1, wherein the first vertical axis and the second vertical axis are coplanar with the horizontal axis, the guide support, and the support rod.

11. The apparatus of claim 1, further comprising:

a pad disposed on the base for guiding positioning of the user's foot.

12. The apparatus of claim 1, wherein the support member extends along the first vertical axis; and wherein the support rod extends along the second vertical axis;

wherein the first vertical axis and the second vertical axis are parallel.

* * * * *